US005527222A

United States Patent [19]

Demita

[11] Patent Number: 5,527,222

[45] Date of Patent: Jun. 18, 1996

[54] BALLOON POPPING DEVICE

[76] Inventor: Tab A. Demita, 8 Peck Ave., Trenton, N.J. 08618

[21] Appl. No.: 408,540

[22] Filed: Mar. 22, 1995

[51] Int. Cl.[6] ..... A63H 37/00; A63J 23/00

[52] U.S. Cl. ..... 472/56; 472/51; 446/220

[58] Field of Search ..... 472/51, 52, 53, 472/56, 134, 137; 273/458, 380; 446/220, 224, 4

[56] References Cited

U.S. PATENT DOCUMENTS

| | | | |
|---|---|---|---|
| 3,092,388 | 6/1963 | Wagenheim | 446/220 X |
| 3,608,903 | 9/1971 | Cooper | 446/220 X |
| 3,685,825 | 8/1972 | Dorazio | 273/458 |
| 3,861,684 | 1/1975 | Gastin et al. | 273/458 X |
| 4,169,593 | 10/1979 | Wood | 446/220 X |
| 4,881,733 | 11/1989 | Rehkemper et al. | 472/56 X |

*Primary Examiner*—Kien T. Nguyen

[57] ABSTRACT

A device for rupturing a balloon in response to an opening of a door. The inventive device includes a piercing assembly mountable over a door for supporting and selectively piercing a balloon. A trigger assembly coupled to the piercing assembly is responsive to an opening of the door to actuate the piercing assembly so as to rupture the balloon over an individual.

6 Claims, 3 Drawing Sheets

Fig. 3
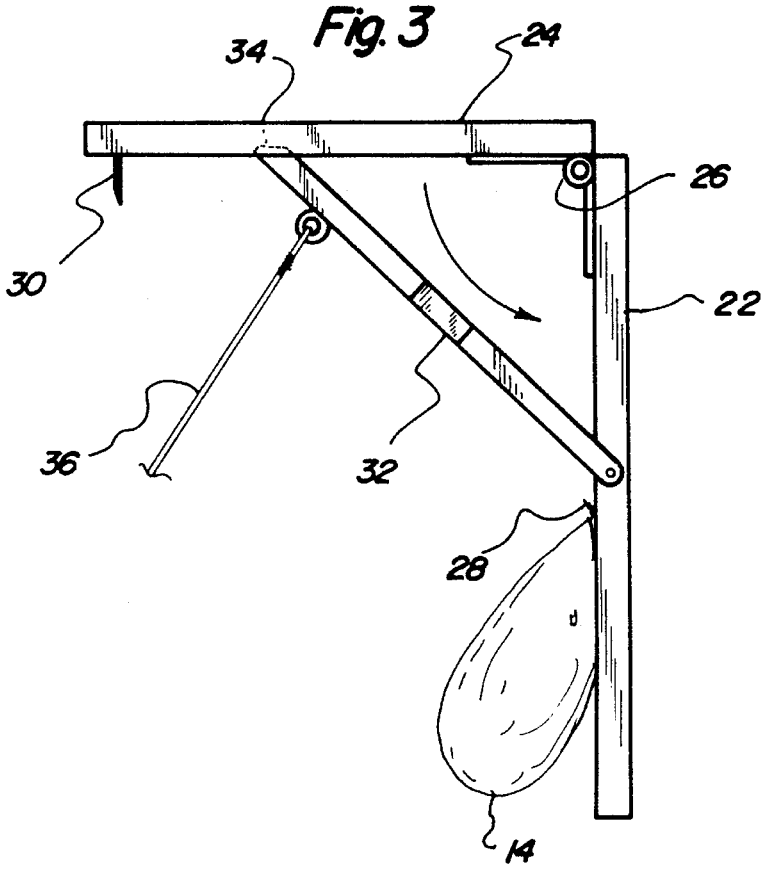
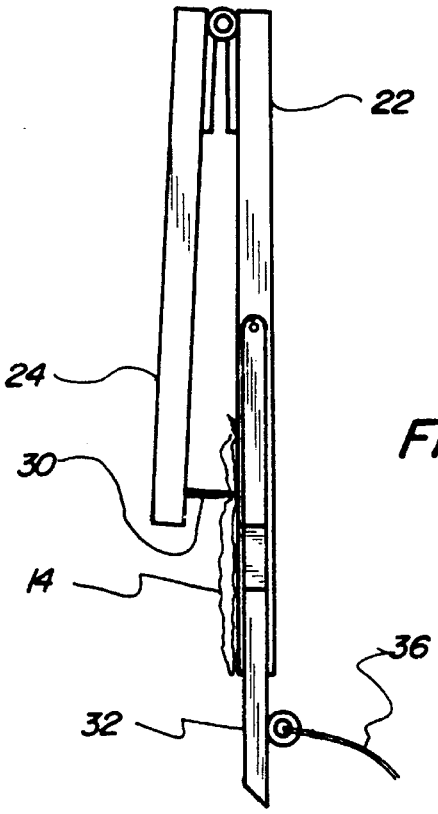
Fig. 4

BALLOON POPPING DEVICE

BACKGROUND OF THE INVENTION

1. Field of the Invention

The present invention relates to automatic piercing structures and more particularly pertains to an balloon popping device for rupturing a balloon is response to an opening of a door.

2. Description of the Prior Art

The use of automatic piercing structures is known in the prior art. More specifically, automatic piercing structures heretofore devised and utilized are known to consist basically of familiar, expected and obvious structural configurations, notwithstanding the myriad of designs encompassed by the crowded prior art which have been developed for the fulfillment of countless objectives and requirements.

While the prior art automatic piercing structures fulfill their respective, particular objectives and requirements, the prior art does not disclose a balloon popping device for rupturing a balloon in response to an opening of a door which includes a piercing assembly mountable over a door for supporting and selectively piercing a balloon, and a trigger assembly coupled to the piercing assembly responsive to an opening of the door to actuate the piercing assembly so as to rupture the balloon over an individual passing through the door.

In these respects, the balloon popping device according to the present invention substantially departs from the conventional concepts and designs of the prior art, and in so doing provides an apparatus primarily developed for the purpose of rupturing a balloon in response to an opening of a door.

SUMMARY OF THE INVENTION

In view of the foregoing disadvantages inherent in the known types of automatic piercing structures now present in the prior art, the present invention provides a new balloon popping device construction wherein the same can be utilized for selectively popping a balloon over an individual walking through a door. As such, the general purpose of the present invention, which will be described subsequently in greater detail, is to provide a new balloon popping device apparatus and method which has many of the advantages of the automatic piercing structures mentioned heretofore and many novel features that result in a balloon popping device which is not anticipated, rendered obvious, suggested, or even implied by any of the prior art automatic piercing structures, either alone or in any combination thereof.

To attain this, the present invention generally comprises a device for rupturing a balloon in response to an opening of a door. The inventive device includes a piercing assembly mountable over a door for supporting and selectively piercing a balloon. A trigger assembly coupled to the piercing assembly is responsive to an opening of the door to actuate the piercing assembly so as to rupture the balloon over an individual.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new balloon popping device apparatus and method which has many of the advantages of the automatic piercing structures mentioned heretofore and many novel features that result in a balloon popping device which is not anticipated, rendered obvious, suggested, or even implied by any of the prior art automatic piercing structures, either alone or in any combination thereof.

It is another object of the present invention to provide a new balloon popping device which may be easily and efficiently manufactured and marketed.

It is a further object of the present invention to provide a new balloon popping device which is of a durable and reliable construction.

An even further object of the present invention is to provide a new balloon popping device which is susceptible of a low cost of manufacture with regard to both materials and labor, and which accordingly is then susceptible of low prices of sale to the consuming public, thereby making such balloon popping devices economically available to the buying public.

Still yet another object of the present invention is to provide a new balloon popping device which provides in the apparatuses and methods of the prior art some of the advantages thereof, while simultaneously overcoming some of the disadvantages normally associated therewith.

Still another object of the present invention is to provide a new balloon popping device for rupturing a balloon in response to an opening of a door.

Yet another object of the present invention is to provide a new balloon popping device which includes a piercing assembly mountable over a door for supporting and selectively piercing a balloon, and a trigger assembly coupled to the piercing assembly responsive to an opening of the door to actuate the piercing assembly so as to rupture the balloon over an individual passing through the door.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side elevation view thereof.

FIG. 4 s a further side elevation view of the invention.

DESCRIPTION OF THE PREFERRED EMBODIMENT

Figure 1:
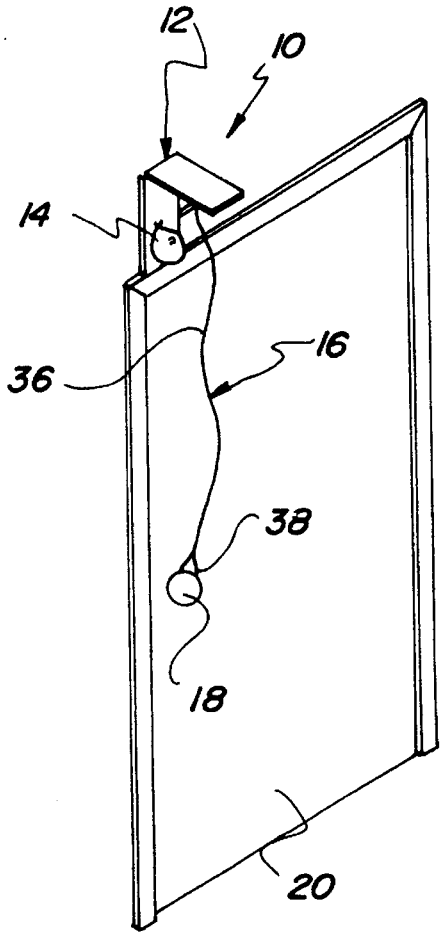
FIG. 1 is an isometric illustration of a balloon popping device according to the present invention in use.

With reference now to the drawings, and in particular to FIGS. 1–6 thereof, a new balloon popping device embodying the principles and concepts of the present invention and generally designated by the reference numeral 10 will be described.

More specifically, it will be noted that the balloon popping device 10 comprises a piercing means 12 for supporting a balloon 14 relative to a support surface such as a wall as illustrated in FIG. 1 of the drawings, and for selectively piercing or rupturing the balloon 14. A trigger means 16 is coupled to the piercing means 2 and couplable to a door knob 18 of a door 20 so as to effect actuation of the piercing means 12 in response to an opening of the door 20 by an individual walking through the associated the door frame. By this structure, the piercing means 12 will selectively rupture the balloon 14 in response to an opening of the door 20 so as to dispense contents of the balloon onto an individual residing therebelow.

Figure 2:
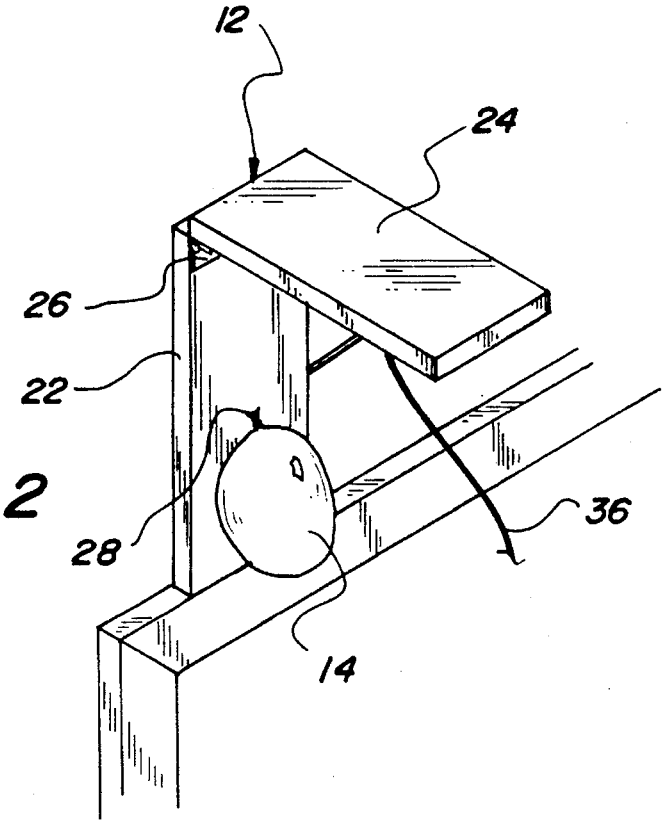
FIG. 2 is an enlarged isometric illustration of the invention.

As best illustrated in FIGS. 2 through 4, it can be shown that the piercing means 2 according to the present invention 10 preferably comprises a fixed member 22 securable to a vertical wall surface or the like substantially above the door 20 as shown in the drawings. A pivoting member 24 is pivotally coupled to the fixed member 22 by a hinge 26. A support hook 28 extends from the fixed member 22 for engaging and supporting a balloon 14 along a front face of the fixed member. As shown in FIGS. 3 and 4, a piercing element 30 extends from the pivoting member 24 and is configured for piercing engagement with the balloon 14 when suspended from the support hook 28 in front of the fixed member 22. By this structure, a rotation of the pivoting member 24 from the horizontal position illustrated in FIGS. 2 and 3 into the vertical position illustrated in FIG. 4 will result in engagement of the piercing element 30 against the balloon 14 so as to cause a rupturing thereof. The contents of the 15 balloon 14, which may include pressurized air, confetti, or fluid, will then be dispensed onto an individual residing below the balloon 14 to constitute a practical joke.

As shown in FIGS. 1 through 4, the trigger means 16 according to the present invention 10 preferably comprises a support arm 32 pivotally mounted to the fixed member 22. The pivoting member 24 is shaped so as to define a notch 34 directed thereinto, with the support arm 32 residing within the notch 34 of the pivoting member 24 so as to support the same in the horizontal position illustrated in FIGS. 1 through 3 of the drawings. A tether 36 is coupled to the support arm 32 and extends therefrom to terminate in a loop 38 positionable about the door knob 18 of the door 20. The tether 36 is coupled to the support arm 32 such that a tensioning of the tether will pull the support arm 32 from the notch 34 so as to permit a gravitationally induced rotation of the pivoting member towards the fixed member 22 such that the piercing element engages the balloon 14 to effect rupturing thereof. By this structure, an individual opening the door 20 will effect tensioning of the tether 36 and subsequent rupturing of the balloon 14 as described above.

Figure 5:
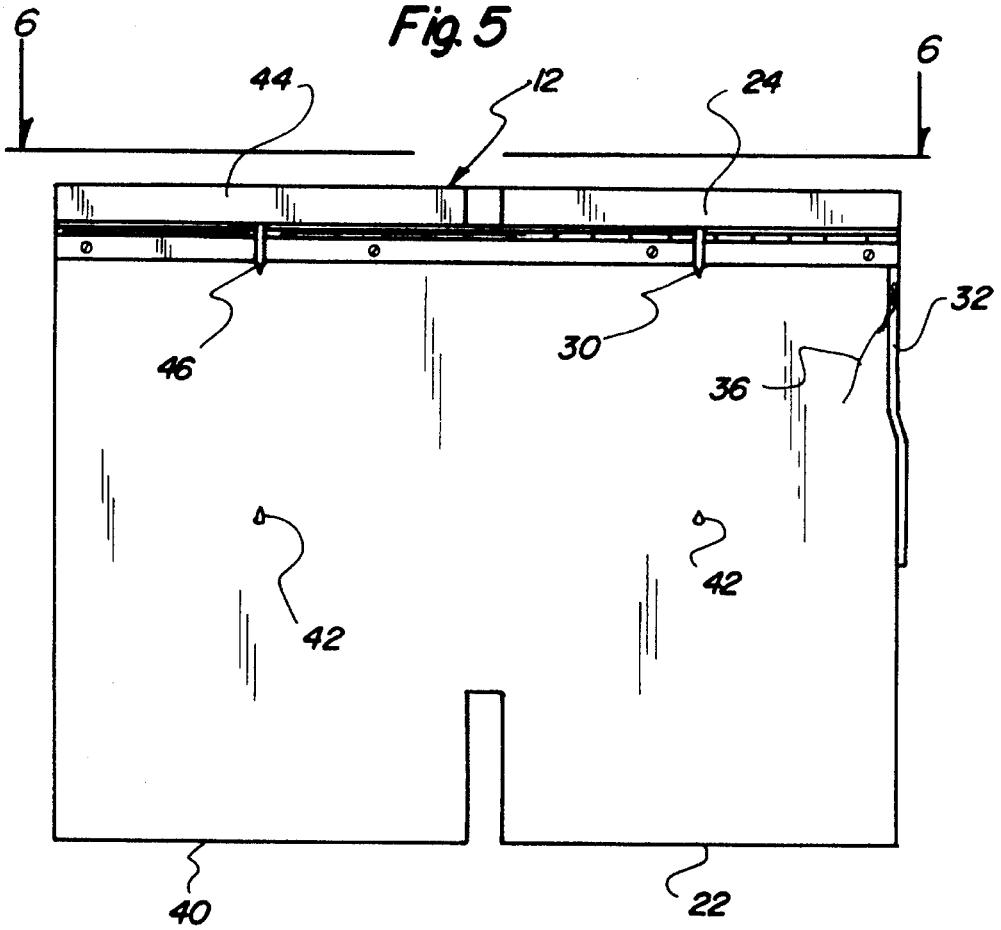
FIG. 5 is a front elevation view of an alternative form the present invention.
Figure 6:
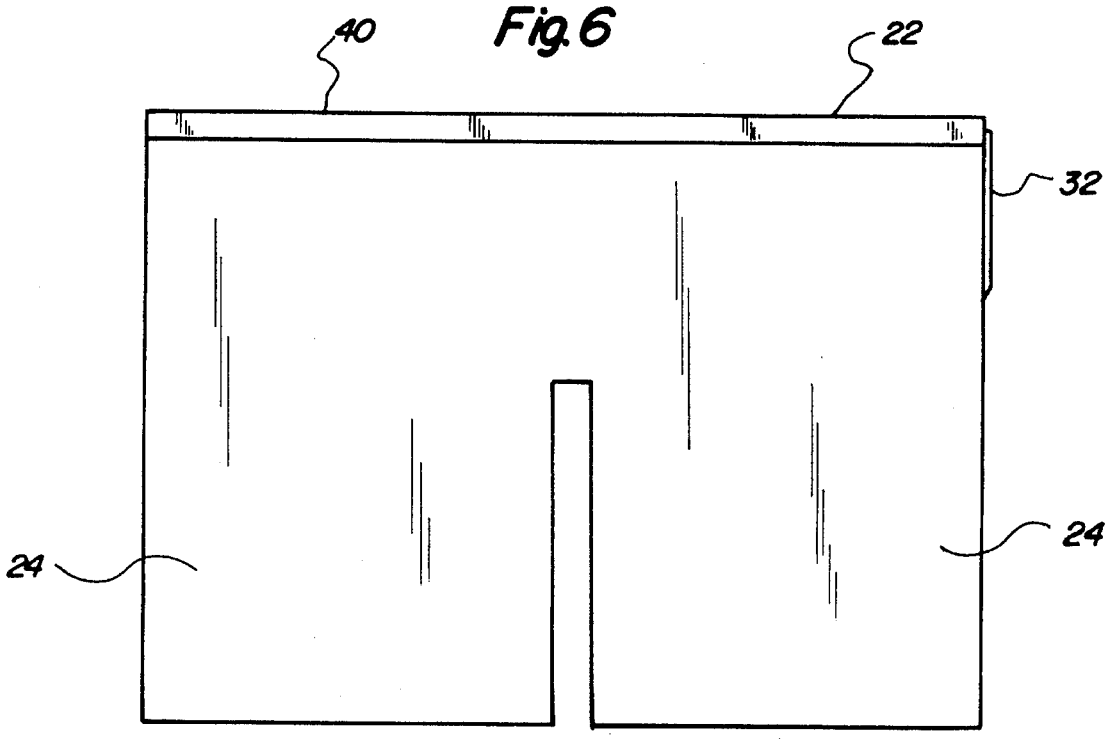
FIG. 6 is a top plan view of the alternative form of the invention taken from line 6–6 of FIG. 5.

Referring now to FIGS. 5 and 6 wherein an alternative form the present invention 10 is illustrated in detail, it can be shown that the piercing means 12 according to the present invention 10 may further comprise a second fixed member 40 secured to the fixed member 22 and including a second support hook 42 extending therefrom for supporting another balloon 14 within the piercing means 12. A second pivoting member 44 is coupled to the pivoting member 24 and includes a second piercing element 46 projecting therefrom. By this structure, a pair of balloons 14 can be suspended from the support hooks 28 and 42 so as to effect simultaneous rupturing of both balloons in response to an opening of a door 20.

In use, the balloon popping device 10 according to the present invention can be easily utilized for effecting rupturing of a balloon 14 positioned above a door 20 so as to dispense contents of the balloons onto an individual entering or exiting through the door. The present invention 10, as noted above, can be utilized in conjunction with a balloon 14 filled with air, fluid, or other material such as confetti or the like to be dispensed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A balloon popping device comprising:

a piercing means for supporting a balloon relative to a support surface and for selectively piercing the balloon, wherein the piercing means comprises a fixed member securable to a wall surface; a pivoting member pivotally coupled to the fixed member; a support member extending from the fixed member for engaging and supporting a balloon along a front face of the fixed member; a piercing element extending from the pivoting member and positioned for piercing engagement with a balloon suspendable from the support member in front of the fixed member:

a trigger means coupled to the piercing means and coupled to a door knob of a door so as to effect actuation of the piercing means in response to an opening of the door.

2. A balloon popping device of claim 1, wherein the trigger means comprises a support arm pivotally mounted to the fixed member, the pivoting member being shaped so as to define a notch directed thereinto, with the support arm residing within the notch of the pivoting member so as to support the same relative to the fixed member; a tether coupled to the support arm and extending therefrom to terminate in a loop positionable about a door knob of a door, the tether being coupled to the support arm such that a tensioning of the tether will pull the support arm from the notch so as to permit a gravitationally induced rotation of the pivoting member towards the fixed member.

3. The balloon popping device of claim 2, and further comprising a second fixed member secured to the fixed member and including a second support member extending therefrom for supporting another balloon within the piercing means; a second pivoting member coupled to the pivoting member and including a second piercing element projecting therefrom such that a pair of balloons can be suspended from the support members to effect simultaneous rupturing of both balloons.

4. A balloon popping device comprising:

a piercing means for supporting a balloon relative to a support surface and for selectively piercing the balloon, and a balloon supported by the piercing means, wherein the piercing means comprises a fixed member securable to a wall surface; a pivoting member pivotally coupled to the fixed member; a support member extending from the fixed member, the balloon being engaged and supported along a front face of the fixed member by the support member; a piercing element extending from the pivoting member and positioned for piercing engagement with said balloon suspendable from the support member in front of the fixed member:

and a trigger means coupled to the piercing means and coupled to a door knob of a door so as to effect actuation of the piercing means in response to an opening of the door.

5. The balloon popping device of claim 4, wherein the trigger means comprises a support arm pivotally mounted to the fixed member, the pivoting member being shaped so as to define a notch directed thereinto, with the support arm residing within the notch of the pivoting member so as to support the same relative to the fixed member; a tether coupled to the support arm and extending therefrom to terminate in a loop positionable about a door knob of a door, the tether being coupled to the support arm such that a tensioning of the tether will pull the support arm from the notch so as to permit a gravitationally induced rotation of the pivoting member towards the fixed member.

6. The balloon popping device of claim 5, and further comprising a second balloon; a second fixed member secured to the fixed member and including a second support member extending therefrom, the second balloon being secured to the second support member within the piercing means; a second pivoting member coupled to the pivoting member and including a second piercing element projecting therefrom such that the balloons can be simultaneously ruptured.

* * * * *